US006223736B1

(12) United States Patent
Yasuga

(10) Patent No.: US 6,223,736 B1
(45) Date of Patent: May 1, 2001

(54) TILE CUTTER

(75) Inventor: Masaki Yasuga, Osaka (JP)

(73) Assignee: Sankei Butusan Co., LTD, Osaka (JP)

( * ) Notice: Subject to any disclaimer, the term of this patent is extended or adjusted under 35 U.S.C. 154(b) by 0 days.

(21) Appl. No.: 09/592,414

(22) Filed: Jun. 13, 2000

(30) Foreign Application Priority Data

Apr. 7, 2000 (JP) ..... 12-106762

(51) Int. Cl.[7] ..... B28D 1/24
(52) U.S. Cl. ..... 125/23.02; 83/886; 225/96.5
(58) Field of Search ..... 125/23.02, 12, 125/24, 16.03; 83/886, 879, 614, 522.11, 522.17; 225/96, 96.5

(56) References Cited

U.S. PATENT DOCUMENTS 5,169,045 * 12/1992 Liu ..... 225/96.5
5,480,081 * 1/1996 Wilson et al. ..... 225/96.5
5,560,274 * 10/1996 Turner ..... 83/886
6,047,871 * 4/2000 Chen ..... 225/96.5
6,148,810 * 11/2000 Hepworth ..... 125/23.02

FOREIGN PATENT DOCUMENTS

2647331 * 4/1977 (DE) ..... 125/23.02
2218375 * 11/1989 (GB) ..... 125/23.02
52-35592 8/1977 (JP) .
55-56008 12/1980 (JP) .

* cited by examiner

*Primary Examiner*—Eileen P. Morgan
(74) *Attorney, Agent, or Firm*—Armstrong, Westerman, Hattori, McLeland & Naughton, LLP

(57) ABSTRACT

A tile cutter provided with a supporting rail of which cross section is inverted T having a straight supporting ridge portion in a longitudinal direction, a front fixation post having a tile contact portion in a direction at right angles with the supporting rail and attached to an end of the supporting rail, a rear fixation post attached to the other end of the supporting rail, a guide rail arranged on upper ends of the front and rear fixation posts and parallel to the supporting rail, a scale for measuring tile cutting dimension having a tile receiving plate of which upper face corresponds to a top portion of the supporting ridge portion and attached onto the supporting rail as to freely slide along the supporting rail, and a tile cutting operation unit, which has an operation lever on an upper portion and a tile pressing leg and a circular cutting blade on a lower portion, attached to the guide rail as to freely slide along the guide rail.

3 Claims, 9 Drawing Sheets

TILE CUTTER

BACKGROUND OF THE INVENTION

1. Field of the Invention

This invention relates to a tile cutter.

2. Description of the Related Art

A conventional tile cutter, for example, as disclosed by Japanese utility model publication No. 52-35592 and No. 55-56008, has a construction in which fixation posts facing each other are formed uniformly with a base of large install area or attached and fixed to the base, a supporting rail is arranged on a line connecting the above fixation posts approximately on a central portion of the base, a tile placing face covered with a tile supporting elastic plate of which thickness is approximately same as height of the supporting rail is formed on the both sides of the supporting rail, a scale for measuring tile cutting dimension is arranged on the base around the tile placing face, a guide rail parallel to and just above the supporting rail is placed on the fixation posts facing each other, and a tile cutting operation unit provided with a cutter and a tile pressing leg protruding to both sides on a lower end portion of an operation lever is supported by the guide rail as to freely slide.

In this conventional tile cutter, however, the tile placing face covered with a tile supporting elastic plate is formed on the both sides of the supporting rail, when the tile pressing leg presses both sides of a cutting line which is drawn by the tile cutting operation unit, the pressing force is dispersed by resistance of the tile supporting elastic plate on the tile placing face and hardly concentrates on the cutting line. Therefore, accurate cutting on the cutting line and making a fine cutting face require skill. Especially, in cutting a thick tile, required degree of skill is high, cracks and chips tend to be generated at both ends of the cutting line etc., defective products are frequently generated thereby.

And, the tile cutter becomes of large width, weight, and volume for the base supporting the tile supporting elastic plate. Cost of making the tile cutter itself increases thereby. Cost is also increased by complicated packing, large amount of packing materials, and transportation of the tile cutter. Further, uneconomical storage and inconvenience of handling are caused on users' side.

Further, in a tile cutter for cutting a large-size tile, bases of which sizes correspond to that of tiles to be cut are required. This causes not only further heavy weight of the tile cutter, but need of making several kinds of bases corresponding to the sizes of the tiles. Uneconomical manufacturing of the tile cutter that increases the manufacturing cost of the tile cutter is caused thereby.

It is therefore an object of the present invention to provide a tile cutter easy to handle and manufactured with low cost with which skill is not required to cut a tile accurately on a diagonal line into rectangles and triangles.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
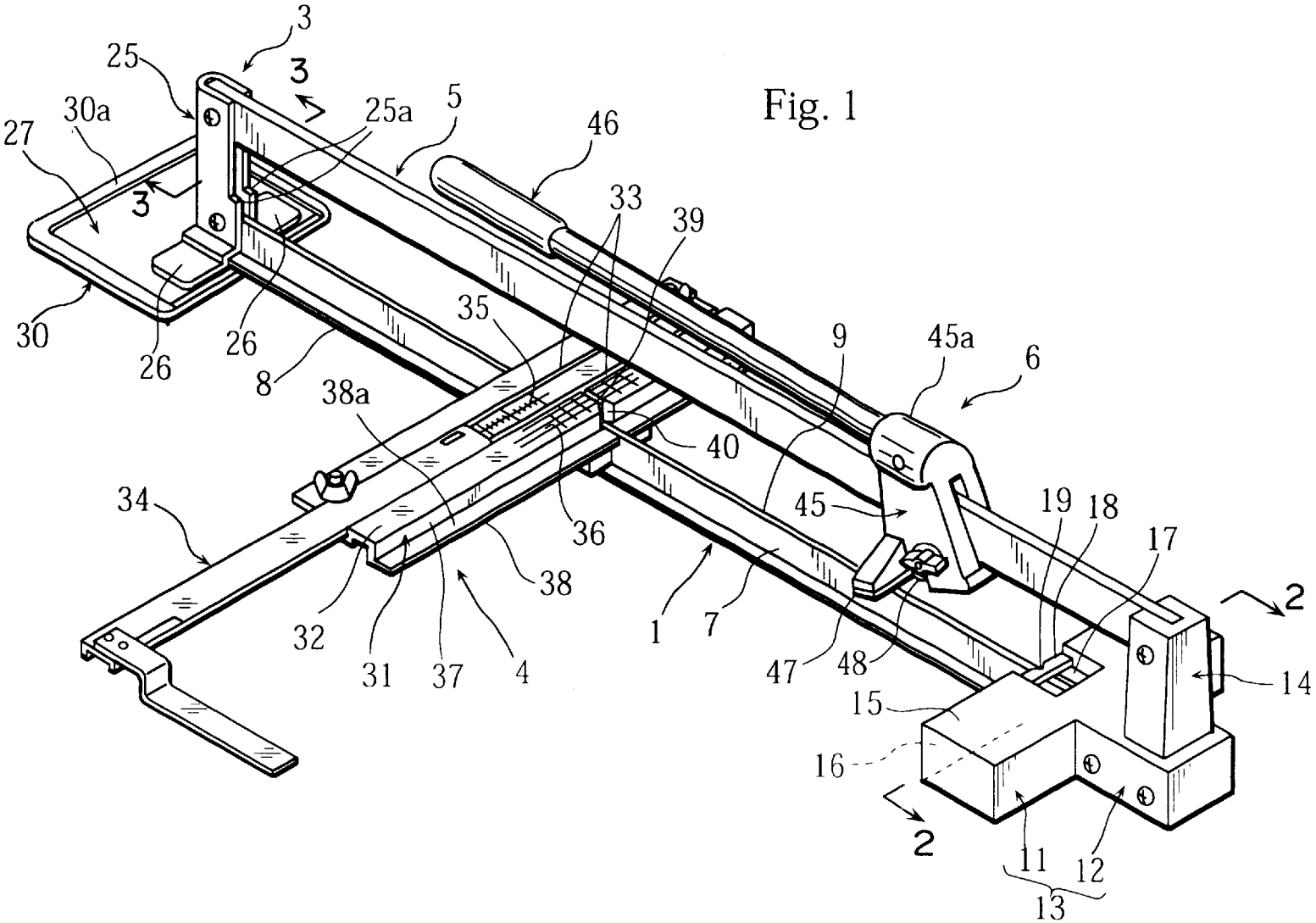
FIG. 1 is a perspective view showing a preferred embodiment of a tile cutter of the present invention.
Figure 2:
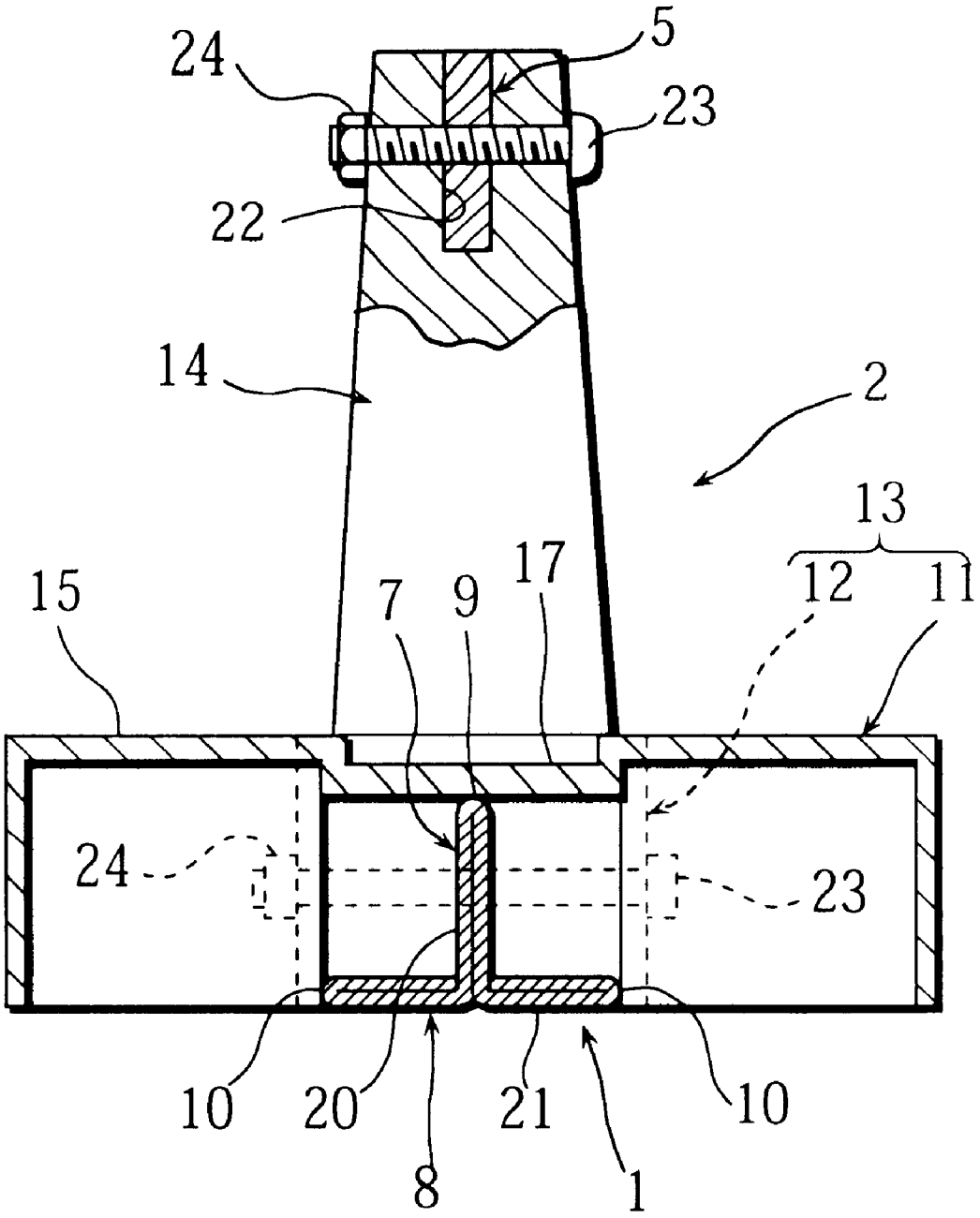
FIG. 2 is a cross-sectional view at an 2—2 line shown in FIG. 1.
Figure 3:
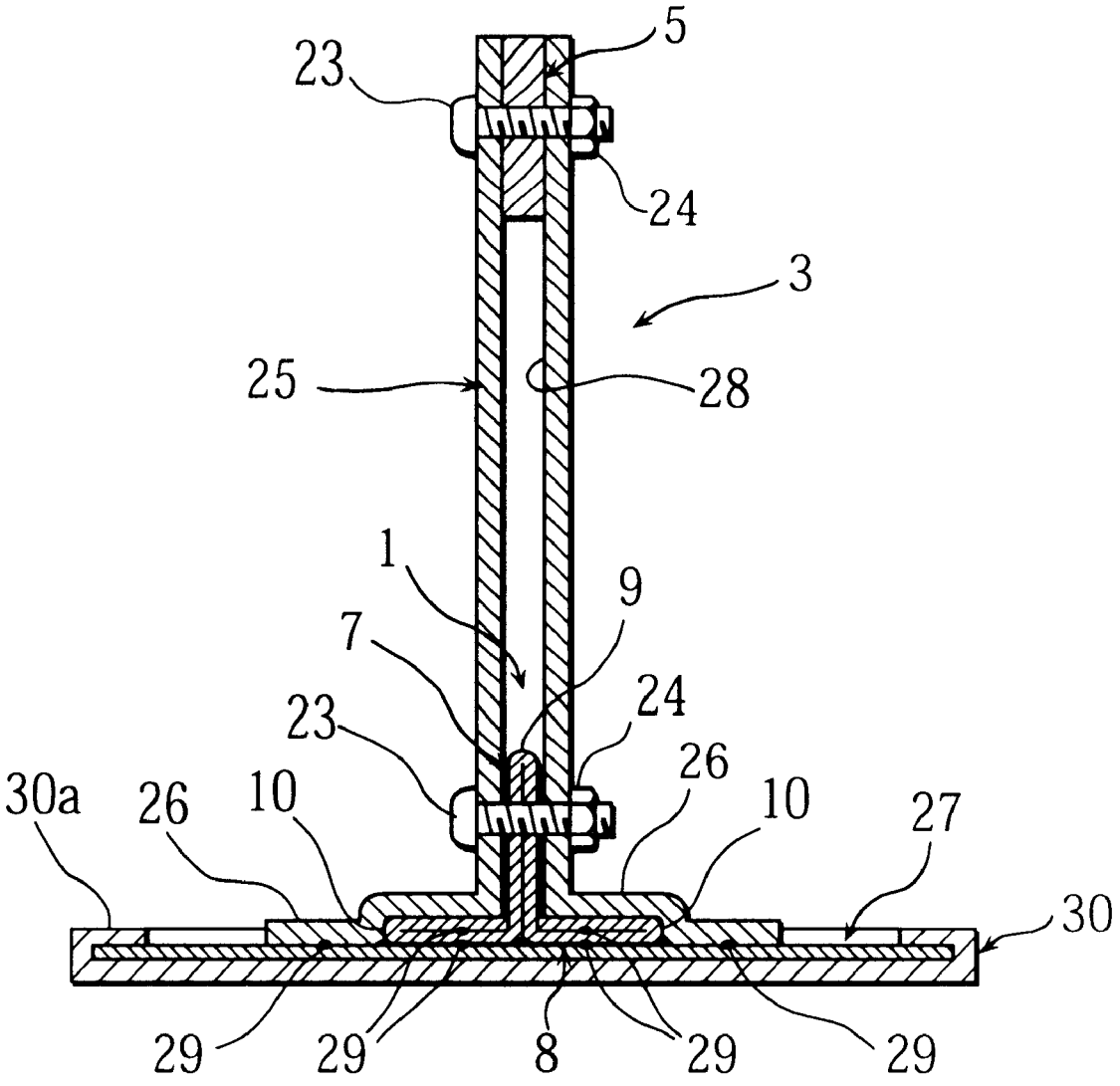
FIG. 3 is a cross-sectional view at a 3—3 line shown in FIG. 1.

FIG. 1 shows a preferred embodiment of a tile cutter of the present invention, FIG. 2 is a cross-sectional view at 2—2 line shown in FIG. 1, and FIG. 3 is a cross-sectional view at 3—3 line shown in FIG. 1. 1 is a supporting rail of which cross section is an inverted T, a front fixation post 2 is attached to an end of the supporting rail 1, and a rear fixation post 3 is attached to the other end of the supporting rail 1. And, 4 is a detachable scale for measuring cutting dimension of a tile, which is arranged on the supporting rail 1 as to freely slide. And, a guide rail 5 is arranged on upper ends of the front fixation post 2 and rear fixation post 3 and parallel to the supporting rail 1, and a tile cutting operation unit 6 is arranged on the guide rail 5 as to freely slide. In the present invention, a longitudinal direction parallel to the supporting rail 1 is defined as a back-and-forth direction, and a direction at right angles with the supporting rail 1 is defined as a left-and-right direction.

To describe concretely, the supporting rail 1, having a straight supporting ridge portion 7 in longitudinal direction and left and right side portions 8 on a lower end of the supporting ridge portion 7, is formed into an inverted T in cross section with band plate steel as to have a rounded top portion 9 of the supporting ridge portion 7 and rounded end portions 10 of the side portions 8. That is to say, the rounded top portion 9 is formed by bending a sheet of band plate steel for 180° at a central portion of the steel, the supporting ridge portion 7 is formed by bending the band plate steel for 90°, and the rounded end portions 10 are formed by bending the band plate steel for 180° at side ends. In this case, the side ends of the band plate steel are placed to angles formed with the supporting ridge portion 7 and the side portions 8. The top portion 9 of the supporting ridge portion 7 and the end portions 10 of the side portions 8 are rounded by forming the supporting rail 1 as described above, and safety for prevention of injury such as cutting hands of operators is enhanced.

The guide rail 5 is formed with steel as to have a rectangular cross section. And, as shown in FIG. 1 and FIG. 2, the front fixation post 2 is composed of a base portion 13 of T-shaped in a top view having a tile contact portion 11 at right angles with the supporting rail 1 and a fixation portion 12 protruding forward from a middle portion of the tile contact portion 11, and a post portion 14 standing on an upper face of the fixation portion 12 of the base portion 13. And, the front fixation post 2 is uniformly die-cast with aluminum as a whole.

Figure 6:
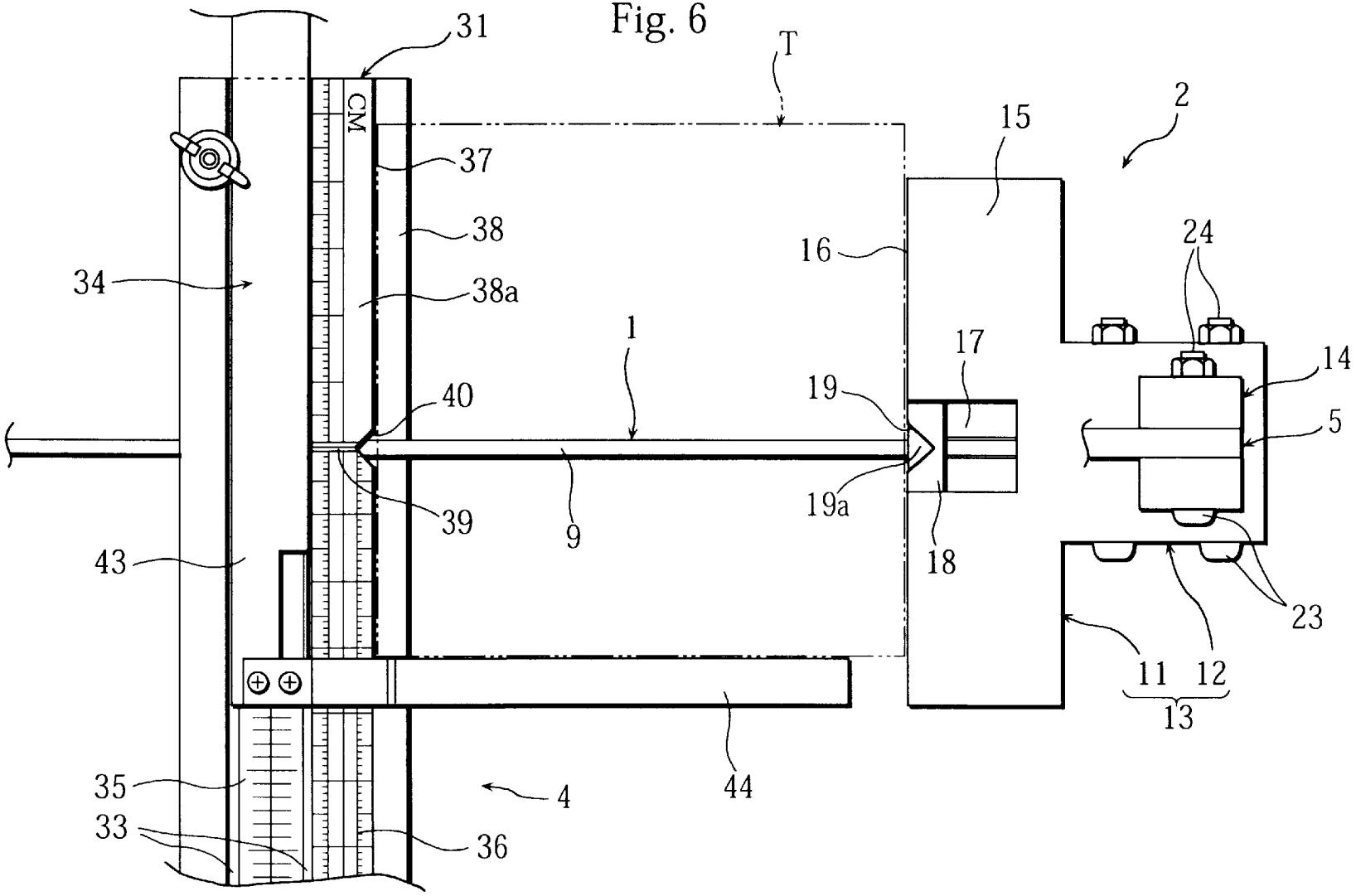
FIG. 6 is an explanatory view showing a set state of a tile.

Concretely, the tile contact portion 11 of the base portion 13 has a rectangular-box shape with a downward opening, a notched concave portion 17 is formed on a rear face 16 side of an upper face 15 middle of the tile contact portion 11, a staged portion 18 is formed on the rear face 16 side of the bottom face of the notched concave portion 17, and an approximately V-shaped notch 19 for tile positioning having a right angle is notched on a middle part on the rear face 16 side of the staged portion 18 in vertical direction leaving a stepped portion 19*a* (refer to FIG. 6). And, the fixation portion 12 of the base portion 13 also has a rectangular-box shape with a downward opening, and a concave groove 20 opening downward for insertion of the supporting ridge portion 7 of the supporting rail 1 is formed in a middle part of the fixation portion 12 in a longitudinal direction. Further, a shallow concave portion 21 opening downward for fitting the both side portions 8 of the supporting rail 1 is formed on a lower part of the fixation portion 12, and a notched groove 22 opening backward is formed on an upper end of the post portion 14.

And, a front end of the guide rail 5 is inserted to the notched portion 22 of the post portion 14, a bolt 23 is inserted to holes disposed on the post portion 14 and the guide rail 5 and fastened with a nut 24, and the guide rail 5 is held by left and right wall portions of the notched groove 22. And, a front end of the supporting rail 1 is inserted to the concave groove 20 and the concave portion 21 of the fixation portion 12, another bolt 23 is inserted to holes disposed on the fixation portion 12 and the supporting rail 1 and fastened with another nut 24, and the supporting ridge portion 7 of the supporting rail 1 is held by left and right wall portions of the concave groove 20.

As shown in FIG. 1 and FIG. 3, the rear fixation post 3 is formed into an inverted T-shape having a post portion 25 having U-shaped cross-sectional configuration for holding a rear end of the guide rail 5 and a rear end of the supporting ridge portion 7, a pair of holding piece portions 26 for holding the side portions 8 of the supporting rail 1 formed on a lower end of the post portion 25, and a flat board portion 27 disposed on a lower face side of the holding piece portions 26.

To describe concretely, the post portion 25 and the pair of holding piece portions 26 are formed with a bent sheet of steel plate, and a slit 28 in vertical direction opening forward is formed in the post portion 25. And, the pair of holding piece portions 26 is bent and formed as to form a concave portion for fitting the side portions 8 of the supporting rail 1.

The side portions 8 of the supporting rail 1 are respectively fixed to an upper face of the flat board portion 27 of the rear fixation post 3 by spot welding. 29 is a welded portion of the spot welding, layered portions of the metal plate forming the side portions 8 are also welded. And, the holding piece portions 26 are placed on the side portions 8 of the supporting rail 1, the supporting ridge portion 7 is inserted to the slit 28 of the post portion 25, and the left and right holding piece portions 26 are respectively fixed to the upper face of the flat board portion 27 by spot welding. Further, the bolt 23 is inserted to the holes formed on the post portion 25 and the supporting rail 1 and fastened with the nut 24. On the other hand, the rear end of the guide rail 5 is inserted to the slit 28 of the post portion 25 of the rear fixation post 3, and the bolt 23 is inserted to the holes formed on the post portion 25 and the guide rail 1 and fastened with the nut 24.

Figure 4:
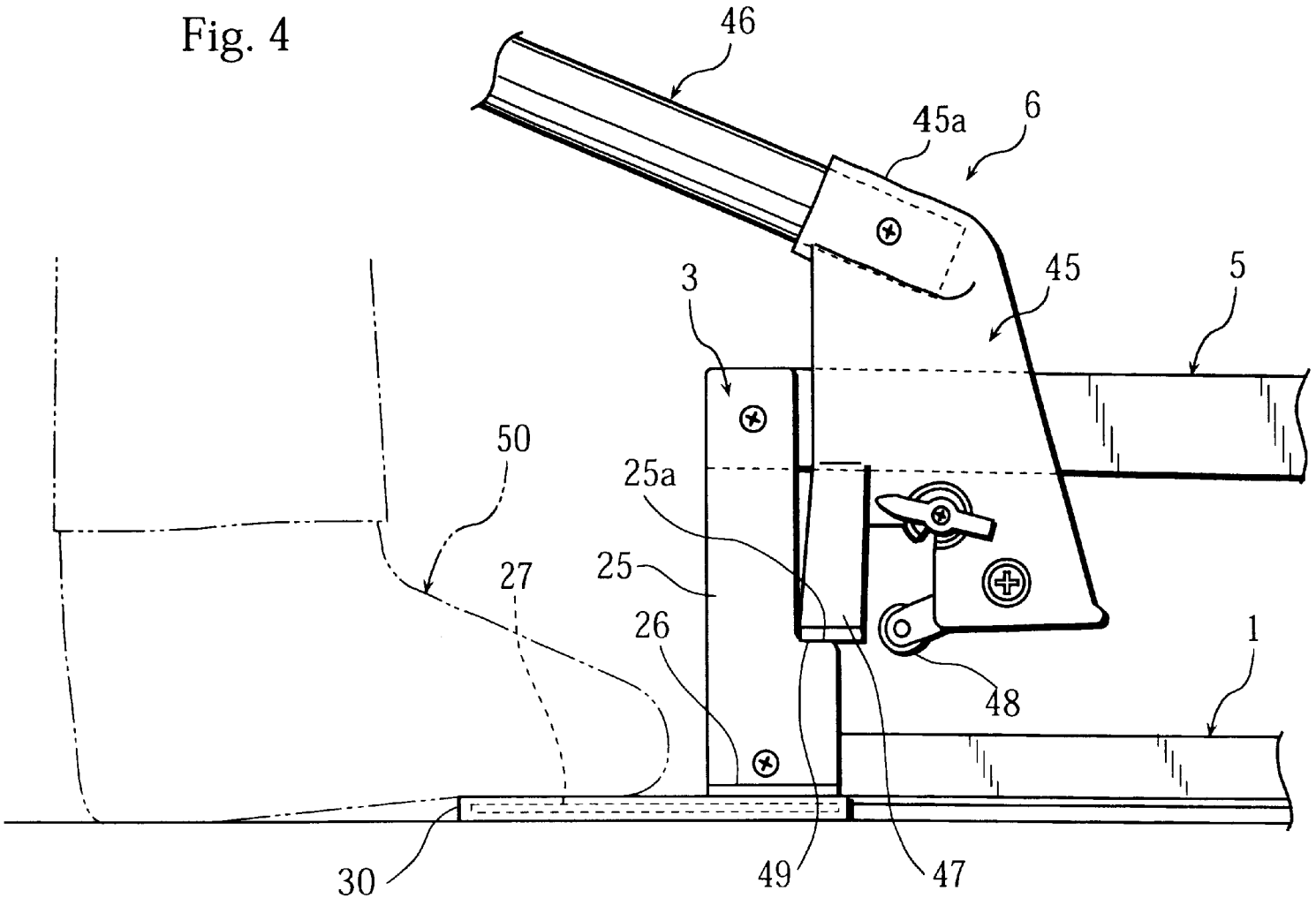
FIG. 4 is a side view of a principal portion showing a state that a tile cutting operation unit is placed on a placement stage portions of a rear fixation post.

As shown in FIGS. 1, 3, and 4, the rectangular flat board portion 27 of the rear fixation post 3 is formed into a size serving as a footboard, and four angles of the flat board portion 27 are rounded. And, the flat board portion 27 is covered with an elastic cover 30 having a holding piece 30*a* which is U-shaped in a top view along the periphery of the upper face of the flat board portion 27. The elastic cover 30, composed of rubber, foamed plastic, etc., is a safety cover to prevent injury in case that an operator falls the tile cutter in handling, and the flat board portion 27 hits the foot of the operator.

And, as shown in FIG. 1 and FIG. 4, placement stage portions 25*a* are formed on the front end of the post portion 25 of the rear fixation post 3 (a front end face of the metal plate bent to be U-shaped). The placement stage portions 25*a*, formed by notching the front end of the upper portion of the post portion 25, is for placing a tile pressing leg (described later) of the tile cutting operation unit 6.

Figure 5:
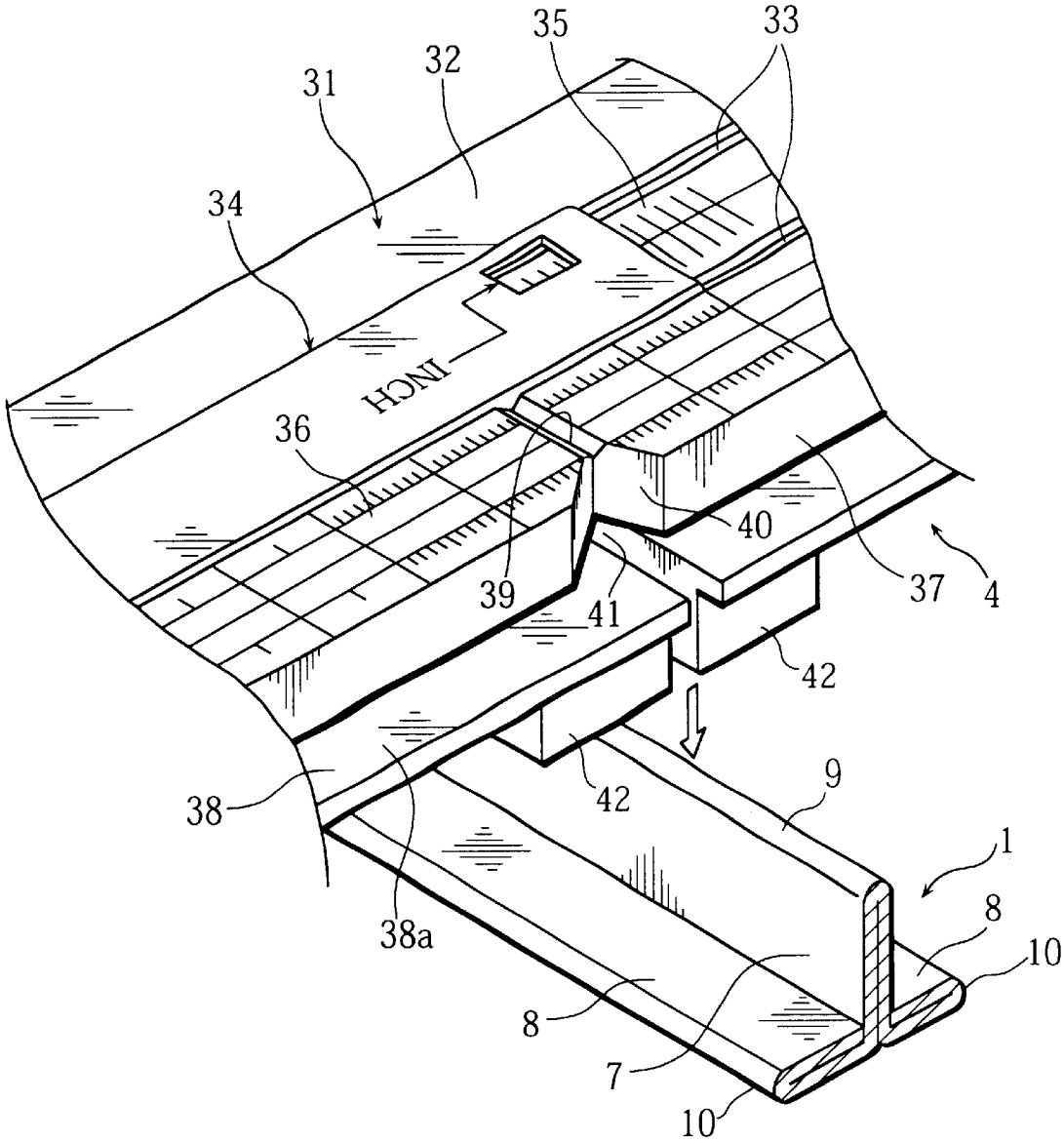
FIG. 5 is an explanatory view showing a state of a scale before set on a supporting rail.

Next, as shown in FIGS. 1, 5, and 6, the scale 4 is provided with a scale main body 31 (made of aluminum, for example) detachably attached to the supporting rail 1 in a direction at right angles with the supporting rail 1 (the left-and-right direction) and an L-shaped sliding scale 34 attached along one pair of guide grooves 33 formed in the left-and-right direction on an upper face 32 of the scale main body 31 as to freely slide.

The scale main body 31 has a graduation 35 graduated in inches between the pair of guide grooves 33, and a graduation 36 graduated in centimeters in front of the graduation 35 in inches. And, a tile receiving plate 38 in the left-and-right direction is arranged on a lower position than the upper face 32 in front of the graduation 36 in centimeters through a stepped face portion 37.

Further, a V-groove 39 is formed in the back-and-forth direction on a base position (a position of 0 cm) on the graduation 36 in centimeters, and the (above-mentioned) notch 40 for tile positioning approximately V-shaped with a right angle is notched vertically on a position of the V-groove 39 of the above stepped face portion 37. That is to say, in a state in which the scale 4 is attached to the supporting rail 1, the notch 40 is disposed as to face the notch 19 of the front fixation post 2.

A slit in the back-and-forth direction is formed on a position corresponding to the above V-groove 39 on the tile receiving plate 38, and a pair of sliding blocks 42 forming a concave groove 41 in the back-and-forth direction with the slit continuously on a lower face of the scale main body 31. That is to say, the scale 4 is attached to the supporting rail 1 slidably and detachably by fitting the concave groove 41 to the supporting ridge portion 7 of the supporting rail 1. In this case, an upper face 38*a* of the tile receiving plate 38 corresponds to the top portion 9 of the supporting ridge portion 7 on the same plane, and the scale 4 is held horizontally by the sliding blocks 42 without trembling. And, width dimension of the concave groove 41 is approximately same as the thickness of the supporting ridge portion 7. And, lower faces of the sliding blocks 42 may contact upper faces of the side portions 8.

And, the sliding scale 34 of the scale 4, is composed of a gate-shaped slide portion 43 having a window portion for reading the graduation 35 in inches on each of the left side and the right side and slidably fitted to the guide grooves 33 of the scale main body 31, and an arm portion 44 for tile-positioning and measuring attached to an end side of the slide portion 43 as to be at right angles with the slide portion 43. And, the sliding scale 34 is fixed to a desirable position with wing nuts and washers screwed on the scale main body 31.

Figure 9:
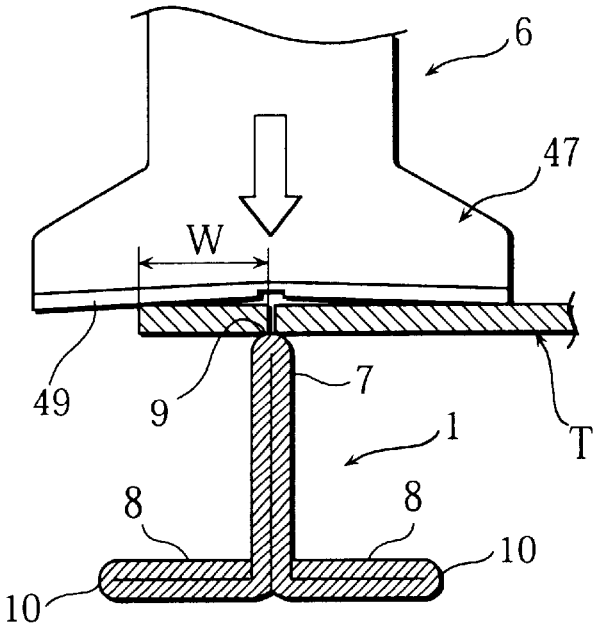
FIG. 9 is a working explanatory view showing a state in which a tile is pressed and cut at a cutting line.

As shown in FIGS. 1, 4, and 9, the tile cutting operation unit 6 has a sliding portion 45 having a through hole to which the supporting rail 1 is inserted, an operation lever 46 inserted and fixed to a cylinder portion 45*a* of an upper portion of the sliding portion 45, and a tile pressing leg 47 and a circular cutting blade 48 on a lower portion of the sliding portion 45. A lower face of the tile pressing leg 47 which inclines slightly downward to the both sides is covered with an elastic sheet piece 49 made of rubber, etc.

Next, working of the tile cutter of the present invention is described. As shown in FIG. 1 and FIG. 6, in a case that a square tile T is cut into rectangles, the tile T is placed on the top portion 9 of the supporting ridge portion 7 of the supporting rail 1 and the upper face 38*a* of the tile receiving plate 38, and the scale 4 is slid forward as a front edge of the tile T contacts the rear face 16 of the tile contact portion 11 of the front fixation post 2. Then, the arm portion 44 of the sliding scale 34 is slid in the left-and-right direction to measure and fix the cutting dimension, and a side edge of the tile T contacts the arm portion 44 for positioning. In this case, the tile cutting operation unit 6 does not interfere with the scale 4 drawn to the rear end of the supporting rail 1 because the tile pressing leg 47 of the tile cutting operation unit 6 is placed on the placement stage portions 25*a* of the post portion 25 of the rear fixation post 3 as shown in FIG. 4.

And, the flat board portion 27 of the rear fixation post 3 is stamped by a foot 50 of an operator (refer to FIG. 4) to fix the tile cutter, and the tile cutting operation unit 6 is moved forward from the rear side to the front side to form (press to cut) a cutting line on the surface (upper face) of the tile T with the circular cutting blade 48. In this case, edge of the circular cutting blade 48 is not damaged for clearance of the V-groove 39 on the scale 4 side and the notched concave portion 17 on the tile contact portion 11 side, and the cutting line is formed thoroughly for a space formed with the notch 40 on the scale 4 side and the tile T and a space formed with the notch 19 on the tile contact portion 11 side and the tile T. And, the elastic cover 30 prevents slippage.

Then, as shown in FIG. 1 and FIG. 9, the operation lever 46 is oscillated downward to press the both sides of the cutting line on the tile T with the pressing leg 47, rear edge of the tile T on the tile receiving piece 38 side slightly raises, reaction force from the supporting ridge portion 7 concentrates on the cutting line, and the tile T is cut (pressed to part) accurately on the cutting line. That is to say, the tile T is cut with fine cutting faces without cracks running out of the cutting line and chips because the tile T is pressed on three points, namely, the top portion 9 of the supporting ridge portion 7 corresponding to the cutting line, and two points, each of which is on the right side and the left side of the cutting line respectively, where the tile pressing leg 47 presses the tile T. In this case, as shown in FIG. 9, accurate cut on the cutting line (fine cutting face) is realized even with a small width W.

Figure 7:
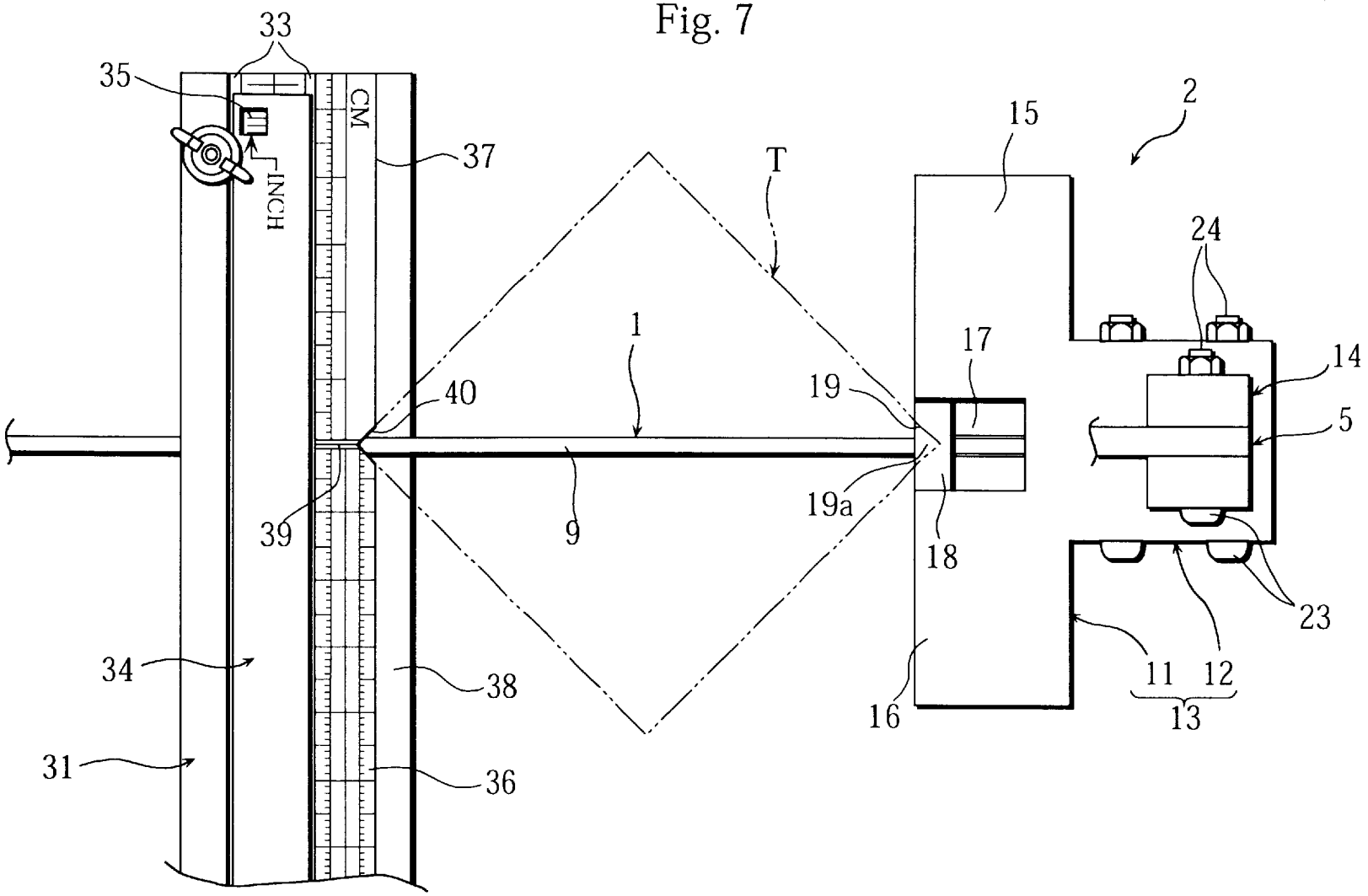
FIG. 7 is an explanatory view showing a set state of a tile cut into triangles.

Next, in a case that the square tile T is cut into triangles, as shown in FIG. 1 and FIG. 7, the tile T is pinched at its two corners facing each other by the notch 19 for tile positioning on the tile contact portion 11 side and the notch 40 for tile positioning on the scale 4 side. The tile T is held by the stepped portion 19*a* of the tile contact portion 11, the supporting rail 1, and the tile receiving plate 38 of the scale 4. And, a diagonal line, on which the tile T is cut, corresponds to the top portion 9 of the supporting ridge portion 7.

In this case, the flat board portion 27 of the rear fixation post 3 is stamped by a foot 50 of an operator (refer to FIG. 4), the tile T is lightly held by a hand to be stable, the tile cutting operation unit 6 is pushed from the rear side to the front side as a cutting line is formed on the diagonal line on the surface (upper face) of the tile T with the circular cutting blade 48. Then, as described with reference to FIG. 9, the tile pressing leg 47 presses the tile T on the both sides of the cutting line, and the tile T is cut into triangles of fine cutting faces without generating cracks and chips running out of the cutting line.

Figure 8:
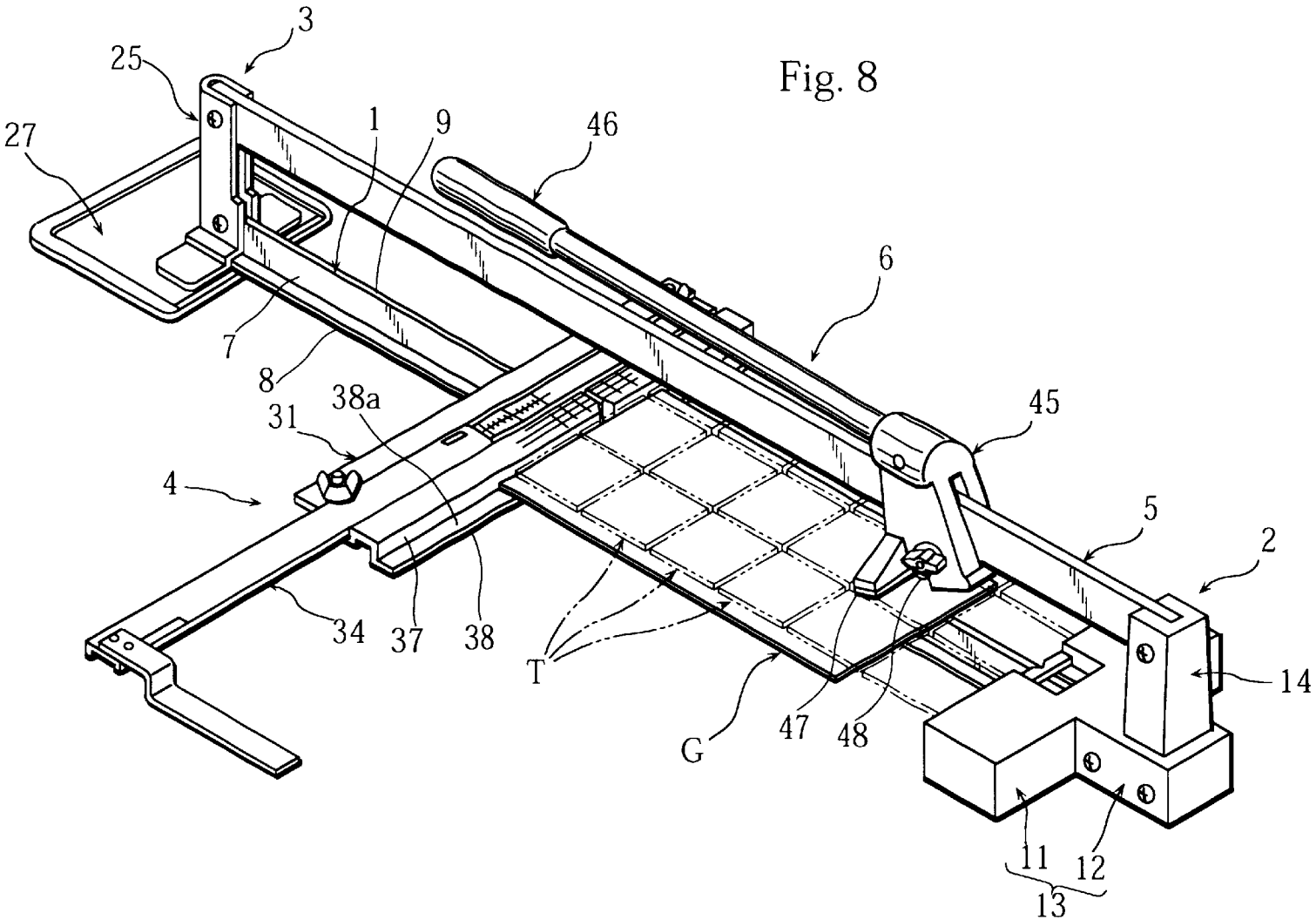
FIG. 8 is a perspective view showing a set state for cutting a mosaic tile.

And, as shown in FIG. 8, a "mosaic tile" composed of plural pieces of tile T, of which reverse sides are stuck to paper or net, or of which sides are connected by applying soft synthetic rubber or plastic, can be cut with the tile cutter of the present invention. In this case, a rectangle receiving board G composed of hard rubber, hard plastic, etc. is placed on the upper face 38*a* of the tile receiving plate 38 of the scale 4 and the top portion 9 of the supporting ridge portion 7 of the supporting rail 1, and the mosaic tile is placed on the receiving board G.

Figure 10:
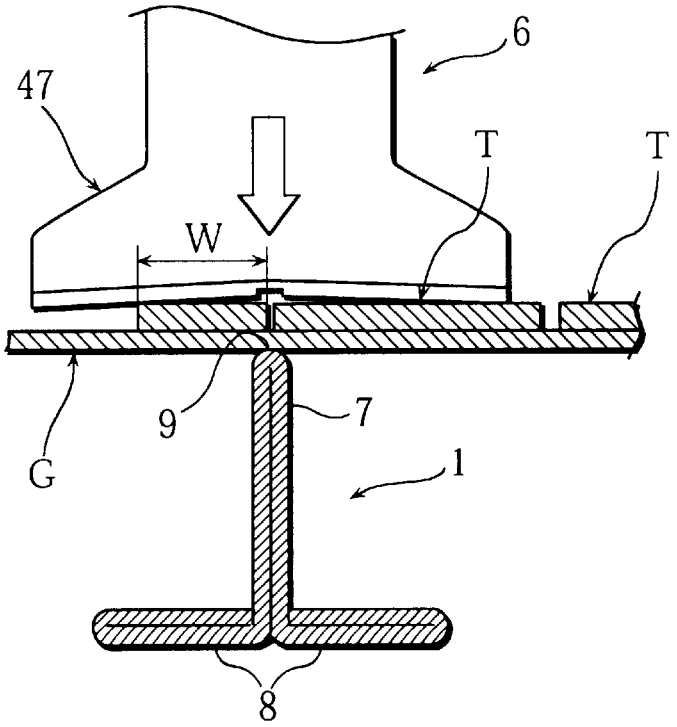
FIG. 10 is a working explanatory view showing a state in which a mosaic tile is pressed and cut at a cutting line.

And, cutting lines are formed on the plural pieces of tile T by the tile cutting operation unit 6, and each piece of the tile T is cut into a predetermined width W by pressing both sides of the cutting line with the tile pressing leg 47 as shown in FIG. 10. In this case, the receiving board G is slightly bent on the both sides of the top portion 9 of the supporting ridge portion 7 of the supporting rail 1 elastically by pressing force of the tile pressing leg 47, reaction force from the supporting ridge portion 7 concentrates on the cutting line, and even the tile T of small width W can be cut with fine cutting face without cracks and chips on the cutting line thereby. And, the mosaic tile, not restricted to a cluster of the square tiles T, can be a cluster of rectangular tiles T, circular tiles T, or tiles T of plural different configurations to be cut.

According to the tile cutter of the present invention, when a cutting line is formed on the tile T by the tile cutting operation unit 6 and pressing force is loaded on the both sides of the cutting line by the tile pressing leg 47, the pressing force (not resisted and dispersed by a tile supporting elastic plate as in conventional tile cutters) concentrates on the cutting line, and accurate cut on the cutting line and fine cutting faces are obtained irrespective of the thickness of the tile, without skill, and even with the small width W. That is to say, problems of cracks and chips conventionally generated on end portions of the cutting line are resolved, and defective products are prevented thereby.

And, for the connecting construction in which the rear fixation post 3 is formed with steel, the flat board portion 27 of the rear fixation post 3 and the supporting rail 1 are welded, and both holding piece portions 26 and the flat board portion 27 are welded, the tile cutter can be simplified with sufficient strength, and production cost can be greatly reduced by reducing the number of parts and cost of dies for die cast with aluminum (in comparison with a conventional tile cutter). And, the tile cutter is easy to carry and handle for its light weight, and operationality is improved thereby. Further, safety, which prevents injury such as cutting hands in handling of the tile cutter, is enhanced by rounding the top portion 9 of the supporting ridge portion 7 and the end portions 10 of the side portions 8.

And, the tile cutting operation unit 6 does not interfere with the scale 4 drawn to the rear end of the supporting rail 1 because the tile pressing leg 47 of the tile cutting operation unit 6 is placed on the placement stage portions 25*a* of the post portion 25 of the rear fixation post 3.

Further, the tile cutter can be fixed by stamping the flat board portion 27 of the rear fixation post 3 with a foot of an operator, and tile cutting work is conducted without instability. And, for example, in case that the operator falls the tile cutter by mistake in handling and the flat board portion 27 hits the foot of the operator, the foot is not injured for the elastic cover 30 covering the flat board portion 27. And, the elastic cover 30 prevents slippage when the flat board portion 27 is stamped in tile cutting.

While preferred embodiments of the present invention have been described in this specification, it is to be understood that the invention is illustrative and not restrictive, because various changes are possible within the spirit and indispensable features.

What is claimed is:

1. A tile cutter comprising:

a supporting rail of which cross section is inverted T having a straight supporting ridge portion in longitudinal direction and left and right side portions on a lower end of the supporting ridge portion;

a front fixation post, having a tile contact portion at right angles with the supporting rail, attached to a front end of the supporting rail;

a rear fixation post attached to a rear end of the supporting rail;

a guide rail arranged on an upper end of the front fixation post and an upper end of the rear fixation post parallel to the supporting rail;

a scale for measuring tile cutting dimension, having a tile receiving plate of which upper face corresponds to a top portion of the supporting ridge portion, attached to the supporting rail in the direction at right angles with the supporting rail as to freely slide along the supporting rail; and a tile cutting operation unit, having an operation lever on an upper portion and a tile pressing leg and a circular cutting blade on a lower portion, attached to the guide rail as to freely slide along the guide rail:

wherein:

the supporting rail is formed by bending band plate steel and having the cross-sectional configuration of inverted T in which a top portion of the supporting ridge portion and left and right end portions of the left and right side portions are rounded;

the rear fixation post is formed with steel into an inverted T having a post portion of which cross section is U-shaped for holding a rear end of the guide rail and a rear end of the supporting ridge portion of the supporting rail, a pair of holding piece portions formed on a lower end of the post portion for holding the left and right side portions of the supporting rail, and a flat board portion disposed on a lower face side of the pair of holding piece portions; and the flat board portion of the rear fixation post and the left and right side portions of the supporting rail are welded, and the holding piece portions and the flat board portion are welded.

2. The tile cutter as set forth in claim 1, wherein placement stage portions are formed on a front end of the post portion of the rear fixation post to put a tile pressing leg of the tile cutting operation unit on the placement stage portions.

3. The tile cutter as set forth in claim 1 or claim 2, wherein the flat board portion of the rear fixation post is formed into a size serving as a foot board, and the flat board portion is covered with an elastic cover.

* * * * *